US005943072A

United States Patent [19]

Robert et al.

[11] Patent Number: 5,943,072

[45] Date of Patent: Aug. 24, 1999

[54] INK-JET PRINTHEAD FOR HIGH RESOLUTION PRINTING AND METHOD FOR OPERATING SAME

[75] Inventors: Michel Robert, Yverdon-Les-Bains, Switzerland; Alcide Clemente, Borgofranco di Ivrea, Italy

[73] Assignee: Olivetti-Lexikon S.p.A., Ivrea, Italy

[21] Appl. No.: 08/940,958

[22] Filed: Oct. 8, 1997

[30] Foreign Application Priority Data

Oct. 17, 1996 [IT] Italy ..... TO96A0849

[51] Int. Cl.[6] ..... B41J 3/04; B41J 2/21

[52] U.S. Cl. ..... 347/40; 347/41; 347/43

[58] Field of Search ..... 347/40, 41, 43, 347/19

[56] References Cited

U.S. PATENT DOCUMENTS 5,109,239 4/1992 Cobbs et al. ..... 347/19

5,570,118 10/1996 Rezanka et al. ..... 347/43

*Primary Examiner*—N. Le

*Assistant Examiner*—Lamson D. Nguyen

*Attorney, Agent, or Firm*—Banner & Witcoff, Ltd.

[57] ABSTRACT

The printhead according to the present invention is mechanically and electrically interchangeable on an ink jet dot printer with a known head, from which it differs substantially by having a different geometrical disposition of the nozzles, arranged in two parallel vertical rows at a constant pitch of $1/150^{th}$ of an inch, where the corresponding nozzles of the two rows are staggered by $1/1600^{th}$ of an inch in order to allow printing with a definition of at least 600×600 dots/inch by performing two consecutive print passes spaced apart by a line feed movement of value equal to $1/300^{th}$ of an inch.

12 Claims, 9 Drawing Sheets

INK-JET PRINTHEAD FOR HIGH RESOLUTION PRINTING AND METHOD FOR OPERATING SAME

FIELD OF THE INVENTION

The device according to this invention is suitable for use in an ink jet dot printer for printing high definition images, whether black or colour, on a medium.

RELATED TECHNOLOGICAL ART

Ink jet dot printers are widely known that perform printing on a medium, typically a sheet of paper, by the relative movement of one or more printheads (for example 4 heads, each fed with ink of a different colour, typically cyan, yellow, magenta and black) with respect to the medium, both horizontally (scanning motion) and vertically (line feed), each head being provided with a group of nozzles for the emission of droplets of ink.

The printing definition that can be obtained, generally expressed as the number of dots of ink per inch deposited on the medium in both the horizontal and vertical directions, for example 300×300 dots/inch corresponding to about 118×118 dots/cm (or more correctly expressed as the maximum definition of the addressable matrix of dots in correspondence with each of which a droplet of ink may be deposited on the medium), depends both on the intrinsic characteristics of the printhead and also on performance characteristics of the printer, in turn depending on the characteristics of the printer mechanical and electric/electronic members.

An example of the former is the pitch at which the nozzles in each group are physically arranged according to the vertical direction; as examples of the latter, there is the minimum value of the line feed (relative movement between head and medium vertically) that the printer can effect and the maximum frequency with which the emission of successive ink droplets can be commanded from any one nozzle.

A typical example illustrating a situation known in the art is the combination of a colour ink jet printhead 20 seen in FIG. 1, of the interchangeable type and having the characteristics described in Italian Patent Application No. TO93A000622 (and in the corresponding European Patent Application published on 18/10/1995 with No. EP 639463), and which will be described in full hereinbelow, with a known type dot printer (for example the Olivetti JP 170), capable of effecting a line feed movement (vertical) having a minimum value of $1/300^{th}$ of an inch and of selectively commanding the emission of droplets from any one nozzle with such a frequency as to print dots on a medium with a horizontal pitch of $1/300^{th}$ of an inch, or, at most, of $1/600^{th}$ of an inch (thus attaining a maximum resolution of 300×600 dots/inch, $1/600^{th}$ of an inch being the horizontal resolution).

The head 20 comprises a plurality of nozzles 22 for the emission of ink droplets (having a typical volume of the order of 80 pl) divided into three groups indicated respectively G, M and C, aligned in the vertical direction, each group being fed an ink of a different colour, yellow, magenta and cyan in the example illustrated. The nozzles 22 of each group are arranged geometrically aligned in two columns 24 and 26, parallel to the line feed direction (vertical) and thus perpendicular to the scanning motion direction (horizontal). Inside each group G, M and C, the nozzles 22 belonging to the same column 24 and 26 are uniformly spaced apart by a distance equivalent to $1/150^{th}$ of an inch (twice the minimum line feed that the printer is capable of effecting), whereas the nozzles 22 of adjacent columns are staggered in the vertical direction by a distance equal to one pitch $p=1/300^{th}$ of an inch (namely, the minimum line feed value). Furthermore the groups G, M, and C of nozzles 22 are spaced apart by an amount differing between one group and the next: more specifically, in the example shown, the distances DCM between the groups C and M, and DGM between the groups M and C (expressed in terms of pitches p) are respectively

DCM=15; DMG=14, whereas the number of nozzles 22 comprising the groups G, M and C is respectively

NC=16; NM=17; NG=18;

With the above-described combination between minimum line feed value and minimum distance between nozzles in the vertical direction ($1/300^{th}$ of an inch in both cases), as already stated, images are obtained that are printed with a resolution of 300×300 dots/inch or, at most, of 300×600 dots/inch. Though satisfactory for most applications, these resolution values are however not high enough to permit the high quality printing of photographic images, for which a printing definition of not less than 600×600 dots/inch is necessary, namely with a resolution of $1/600^{th}$ of an inch vertically as well.

On the other hand, it is known that systems are being increasingly used to permit the recording of photographic images not on a traditional film but instead on a digital format magnetic or optical medium, thereby permitting reproduction and printing not by photographic means but by way of a colour printer, typically ink jet, now widely used even in the home. High resolution printers (for example 600×600 dots/inch) are however considerably expensive and generally superfluous for normal use in offices and homes (the market segment denoted SOHO, Small Office Home Office), where a resolution of 300×300 or 300×600 dots/inch, as seen above, is more than satisfactory.

SUMMARY OF THE INVENTION

Scope of the present invention is that of defining an ink jet printhead mechanically and electrically interchangeable with a known head, with which images can be printed at high definition (at least 600×600 dots/inch), whenever it replaces the known head on a low resolution printer, improving performance of the latter in terms of definition of the images printed, and whenever at the same time a printing method is adopted that arranges for composition of the image to be printed through a number of head scanning passes that is twice that of the known method of operation.

Selective fitting of the printhead according to this invention, by means of an operation easily effected by any operator, makes it possible to obtain performance enhancements from a known printer, that will allow the printing of high definition images, photographic images for example.

A further scope of the invention is that of defining a method for obtaining prints with a resolution of at least 600×600 dots/inch using a printer capable of effecting a line feed movement with a minimum value of $1/300^{th}$ of an inch, by the replacement of only the printhead, or, more generally, for doubling the printing definition obtainable with a dot matrix printer by the alternative usage of a printhead characterized as in claim 1.

The above scopes are obtained by means of an ink jet printhead and associated printing method, characterized as defined in the main claims.

These and other scopes, characteristics and advantages of the invention will become apparent upon consideration of the following description of a preferred embodiment, provided by way of a non-exhaustive example, in conjunction with the accompanying drawings in which:

FIG. 1—Represents disposition of the nozzles in a printhead according to the known art;

FIG. 2—Represents disposition of the nozzles in a printhead according to the present invention;

FIG. 3—Represents disposition of the dots on the printing medium after two consecutive scanning passes have been effected by the printhead according to the present invention; and FIGS. 4*a*–4*f*—Represent six following steps of colour ink deposition according to the present invention

DESCRIPTION OF THE PREFERRED EMBODIMENT

Figure 1:
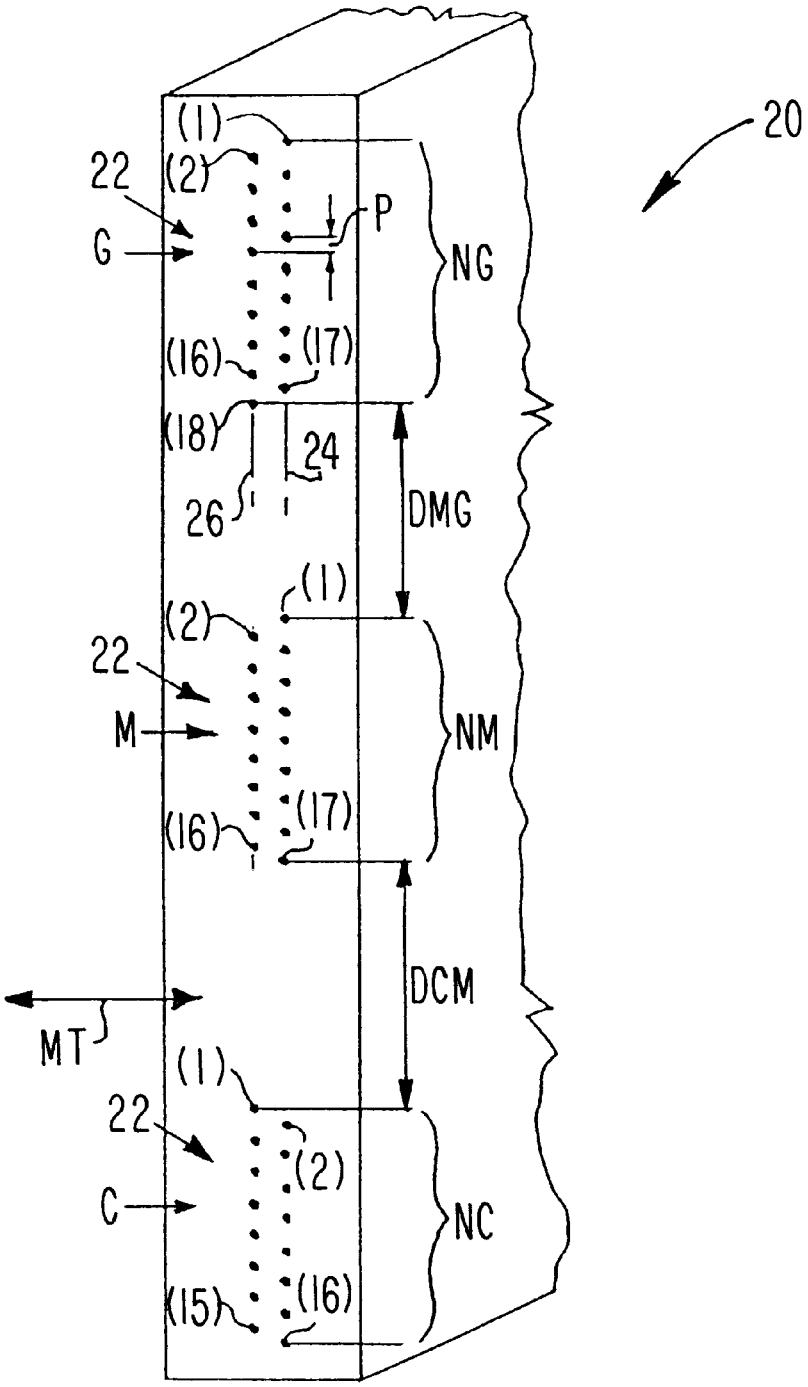
FIG. 1 PRIOR ART
Figure 2:
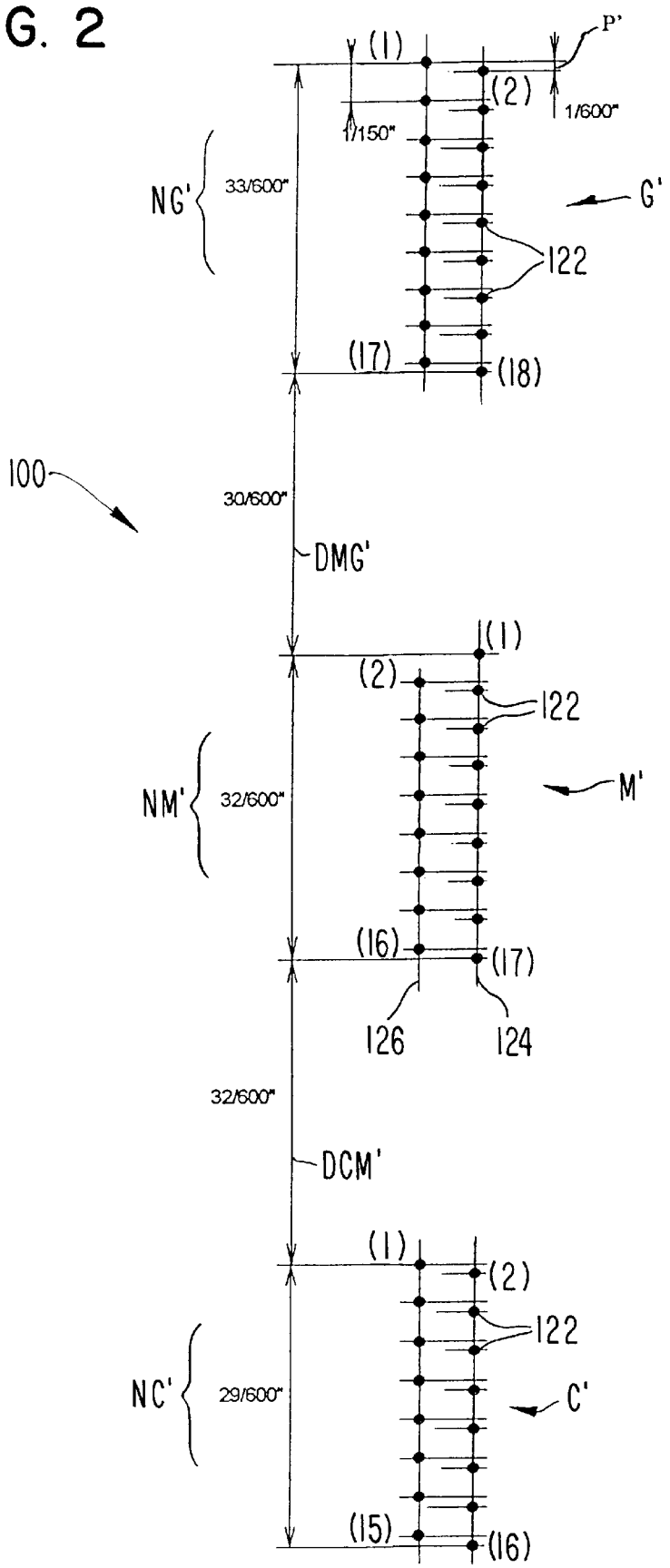

FIG. 2 is a schematic representation of the disposition of the nozzles 122 of a printhead 100 according to this invention, adopting the same terminology and numerical references as those of FIG. 1.

The head 100 comprises a plurality of nozzles 122 for the emission of droplets of ink (having a volume less than that of the known head 20 of FIG. 1, typically in the region of 45 pl) divided into three groups indicated respectively G', M' and C', aligned in the vertical direction (line feed), each group being fed with ink of a different colour, yellow, magenta and cyan in the example illustrated. The nozzles 122 of each group are geometrically arranged aligned in two columns 124 and 126, parallel to the line feed direction (vertical) and thus perpendicular to the direction of the scanning movement (horizontal); the nozzles 122 of each group G', M' and C' belonging to the same column 124 or 126 are spaced apart by a distance that is twice the minimum line feed that the printer is capable of effecting. In the case illustrated, they are therefore $1/150^{th}$ of an inch apart, exactly as in the case of the known head 20 of FIG. 1; on the other hand, the nozzles 122 of adjacent columns (namely, the nozzles 122 belonging to column 124 with respect to the corresponding ones belonging to column 126, namely for example the first nozzle of the group G' of column 126 with respect to the first nozzle of the group G' of column 124, and so on) are staggered in the vertical direction by an amount equivalent to one pitch $p'=1/600^{th}$ of an inch.

The groups G', M', and C' of nozzles 122 comprise the same number of nozzles as on the known head 20 of FIG. 1, that is to say the number of nozzles 122 of the groups G', M' and C' is respectively

NC'=16; NM'=17; NG'=18;

by the same token, the groups G', M' and C' are spaced apart by an amount of space differing between one group and the next, but the distances are different from those of the known head 20 of FIG. 1: more specifically, the distances DCM' between the groups C' and M' and DMG' between the groups M' and G' (expressed in terms of pitches p' of $1/600^{th}$ of an inch) are respectively

DCM'=32; DMG'=30.

Figure 3:
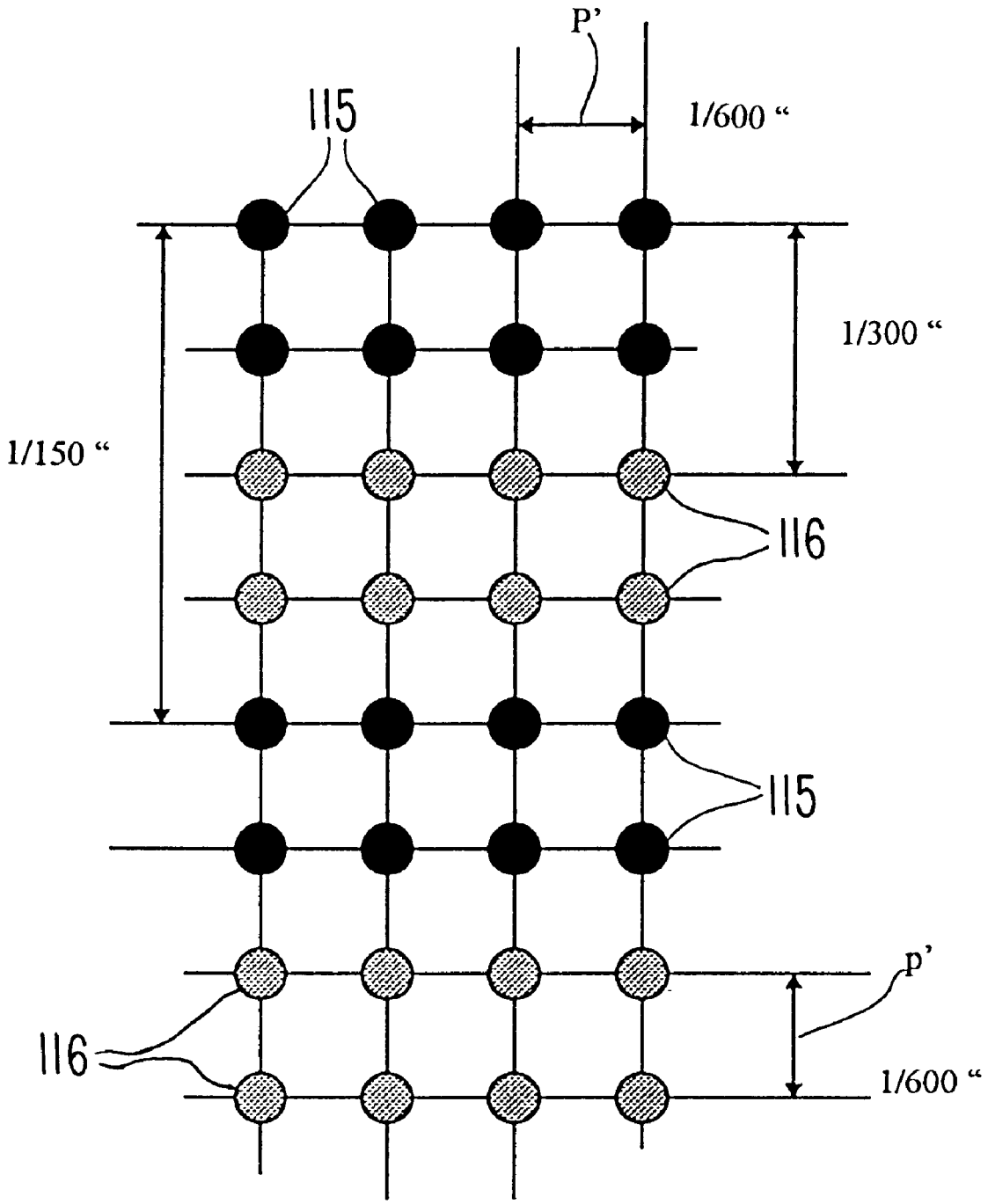

With this geometrical disposition of the nozzles, it will be readily understood that, to address all the dots in a matrix of 600×600 dots/inch, two scans will need to be made consecutively, separated by a line feed movement of minimum size (namely, $1/300^{th}$ of an inch), so that in the first scan, first couples of dots are printed at a pitch of $1/600^{th}$ of an inch both horizontally and vertically, separated in the vertical direction by $1/150^{th}$ of an inch; in the second scan, after a line feed of $1/300^{th}$ of an inch has been effected, second couples of dots are printed, again at a pitch of $1/600^{th}$ of an inch horizontally and vertically, between the first couples of dots, as illustrated in FIG. 3, wherein the dark dots 115 represent the dots printed during the first scan, and the shaded dots 116 represent the dots printed during the second scan.

The colour printing method using the previously described head 100 will be illustrated hereinbelow, with reference to the case in hand, by no means exhaustive, wherein the head 100 can effect the horizontal scanning movement and the medium upon which printing is effected is capable of effecting the vertical line feed movement. In the following, the term pass is used to denote a horizontal scanning movement of the head (whether outgoing or return) with selective emission of ink droplets for printing of a horizontal strip of lines on a medium in the motionless state.

The method according to the invention comprises the steps from a) to f), described below and illustrated by means of the figures from 4*a* to 4*f*, for which the following conventions are stated:

- the right portion of the figure represents one printing pass;
- the left portion of the figure represents the following printing pass;
- the nozzles activated during each printing pass are represented by black dots;
- the nozzles non activated during each printing pass are represented by empty circles;
- the rows of Cyan dots, printed by the nozzles C', are represented by horizontal continuous lines;
- the rows of Magenta dots, printed by the nozzles M', are represented by horizontal rows of "x";
- the rows of Yellow dots, printed by the nozzles G', are represented by horizontal rows of black dots.

Figure 4A:
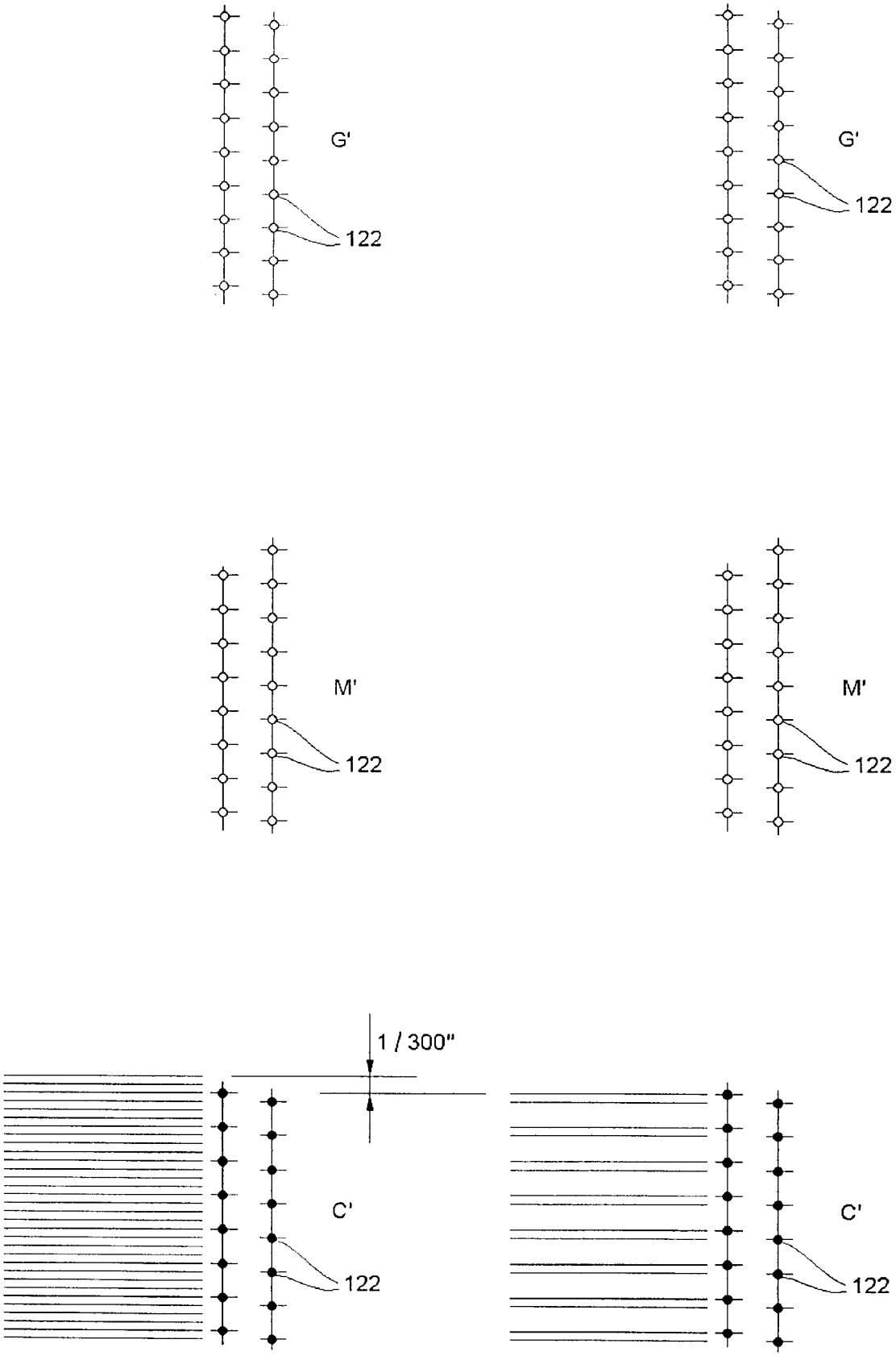
Figure 4B:
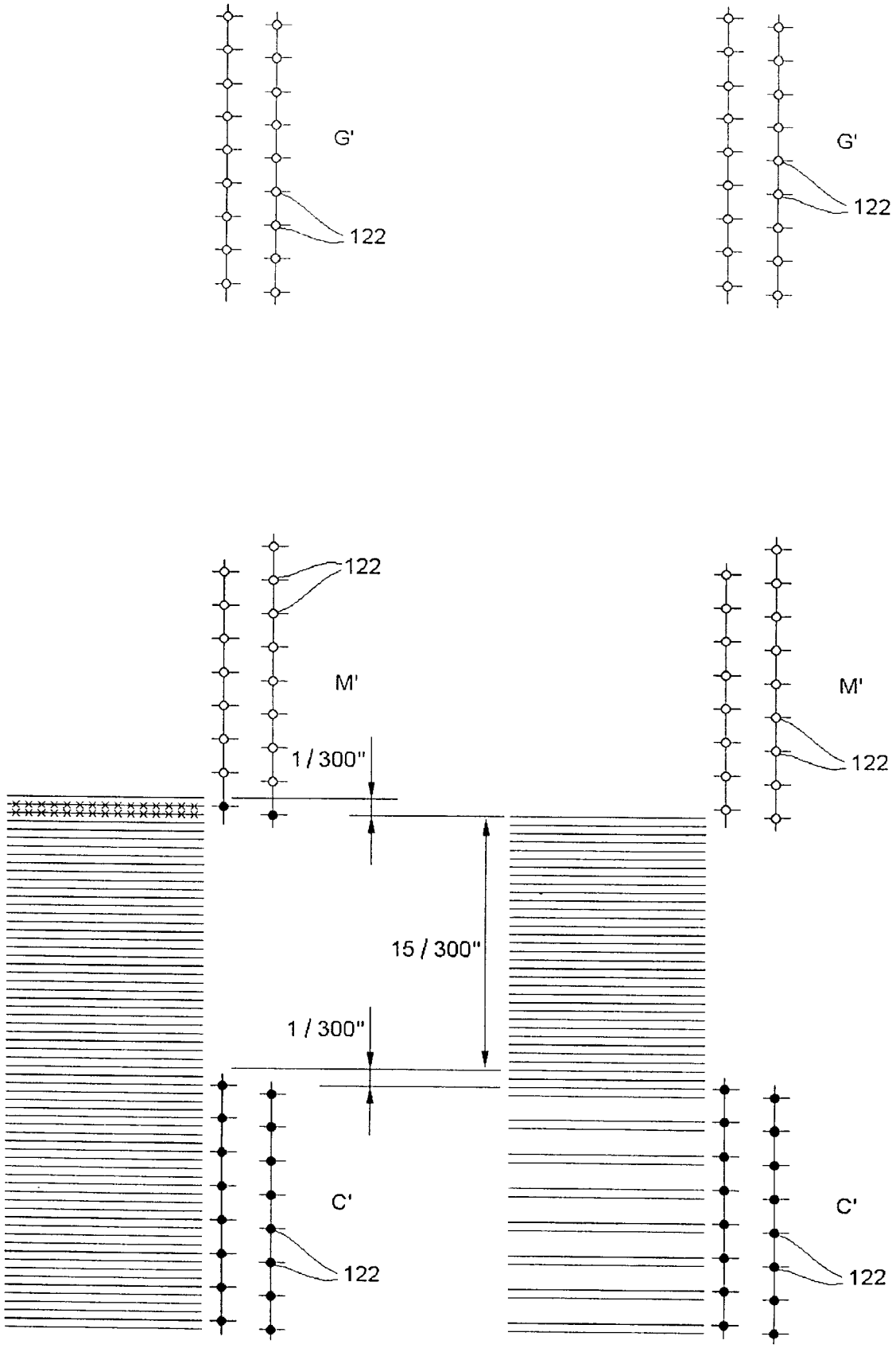
Figure 4C:
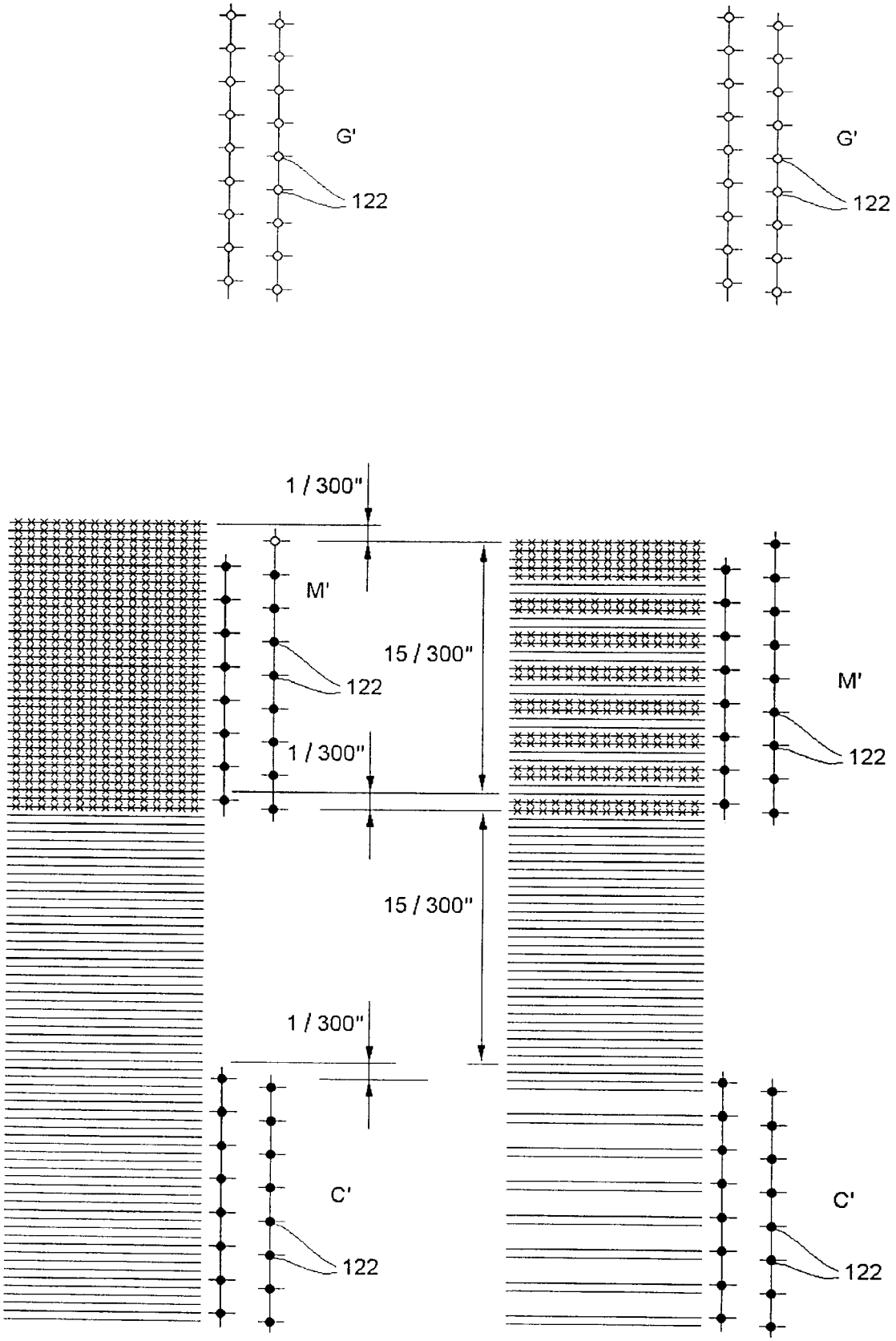
Figure 4D:
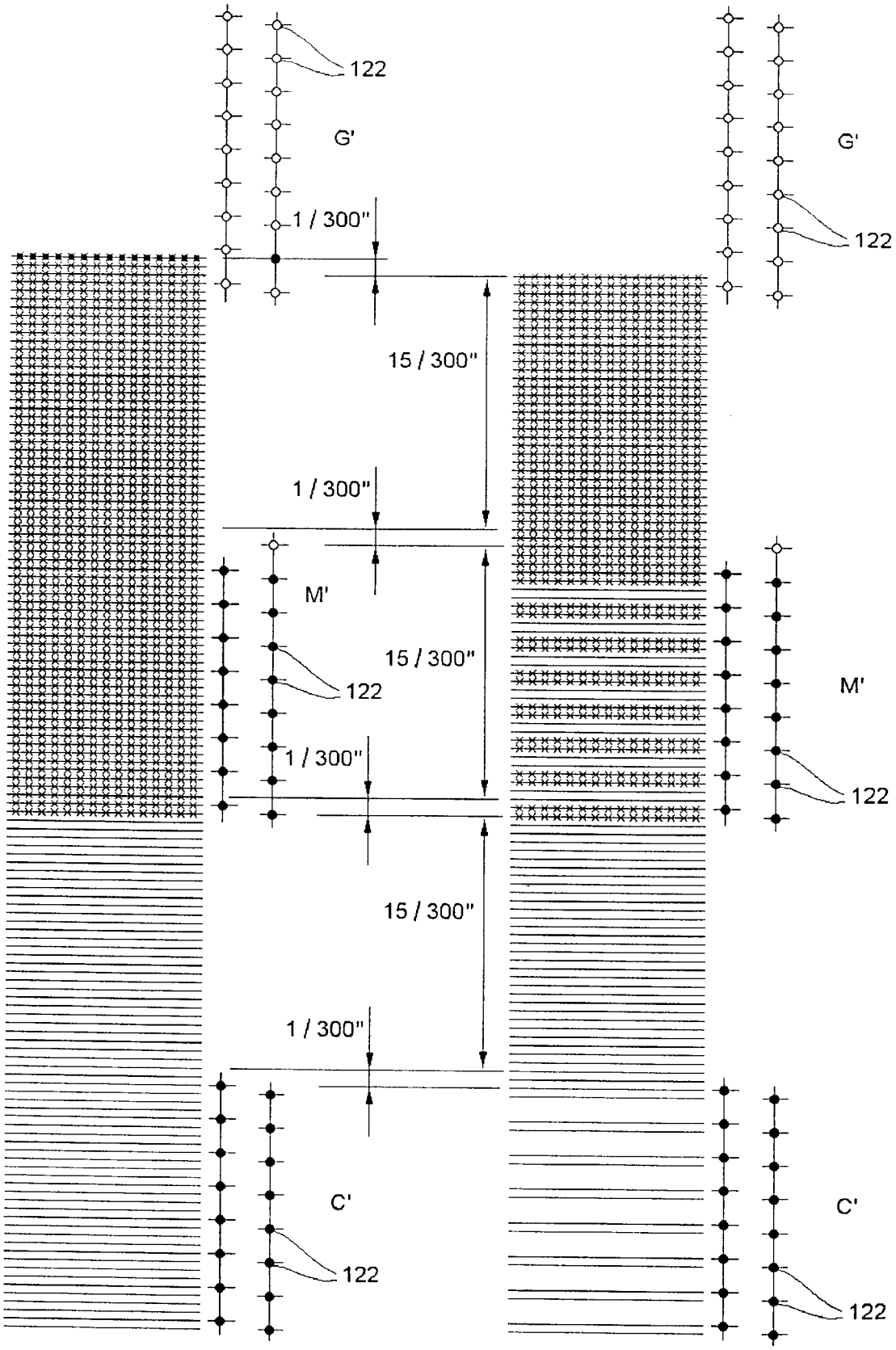
Figure 4E:
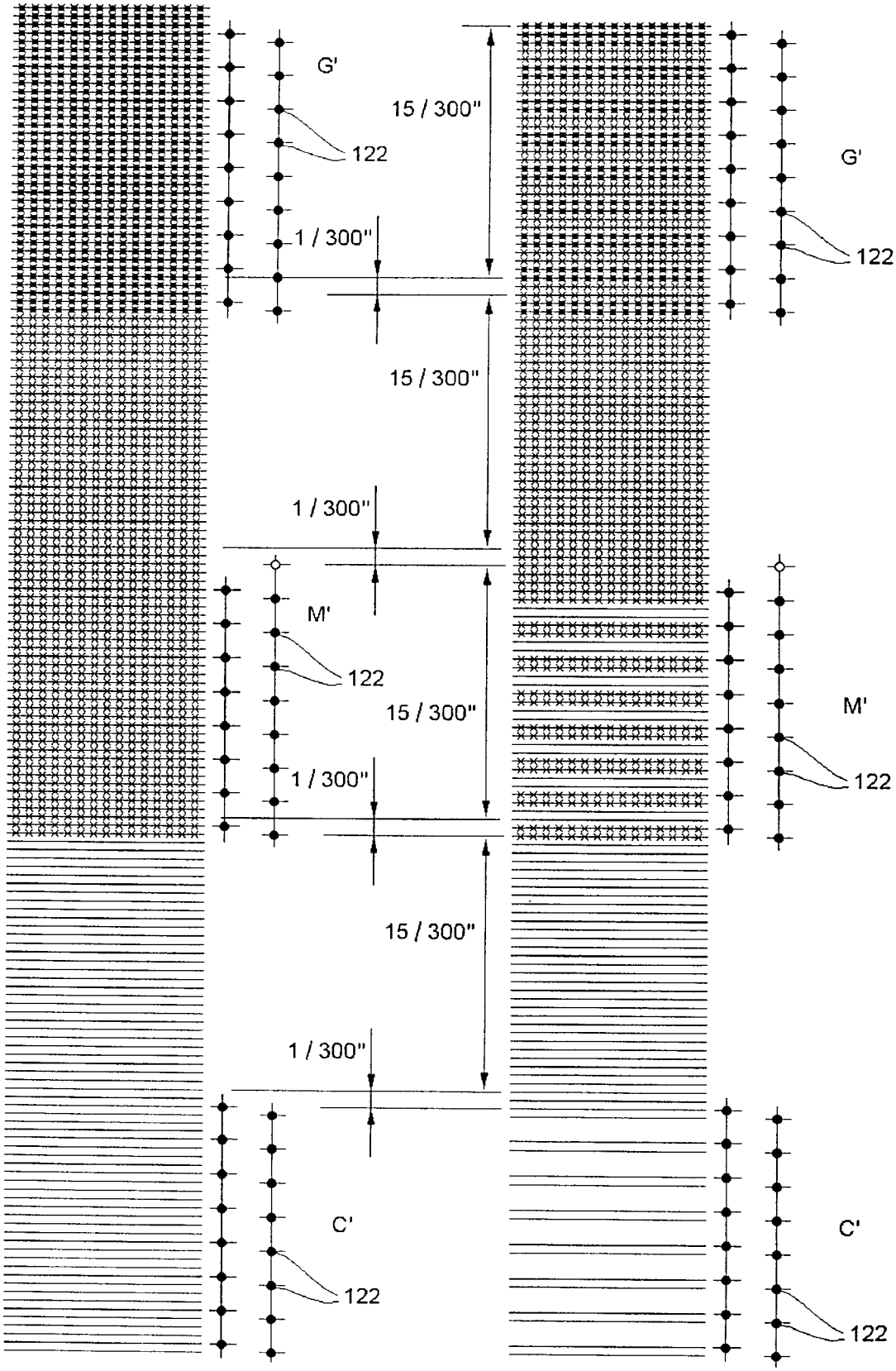

The steps from a) to f) are performed as follows:

a) in a first pass, with the Cyan ink and using the 16 nozzles 122 of the group C', a first incomplete strip is printed having a width of $15/300^{th}$ of an inch, indicated by horizontal continuous lines in FIG. 4*a*, right side; then a line feed of $1/300^{th}$ of an inch is effected and in a second pass (either during the return movement of the head or in a subsequent outgoing movement) the Cyan colour strip is completed with a resolution of 600×600 dots/inch, by inserting the dots printed in this second pass between the dots printed in the first pass, in the way described above [with reference to FIG. 3](FIG. 4*a*, left side).

b) a first line feed of $15/300^{th}$ of an inch is effected, and a second strip of Cyan colour is printed, again having a width of $15/300^{th}$ of an inch, adjacent to the first Cyan colour strip, by means of a third and fourth pass separated by a line feed of $1/300^{th}$ of an inch, in the same way as described above (FIG. 4*b*).

c) a second line feed of $15/300^{th}$ of an inch is effected, and a third Cyan colour strip is printed, again having a width of $15/300^{th}$ of an inch, adjacent to the second Cyan colour strip, by means of a fifth and sixth pass separated by a line feed of $1/300^{th}$ of an inch and simultaneously, using the 17 nozzles 122 of the group M', a first Magenta colour strip is printed, having a width of $16/300^{th}$ of an inch, indicated by horizontal rows of "x" in FIG. 4*c*, superposed on the first Cyan colour strip and overlapping by $1/300^{th}$ of an inch on the second Cyan colour strip.

d) a third line feed of $15/300^{th}$ of an inch is effected (FIG. 4*d*), and a fourth Cyan colour strip is printed, again having a width of $15/300^{th}$ of an inch, adjacent to the third Cyan colour strip, by means of a seventh and eighth pass separated by a line feed of $1/300^{th}$ of an inch and simultaneously, using only 16 nozzles 122 of the group M' (not using the first nozzle, that is therefore represented by an empty circle), a second Magenta colour strip is printed, this time with a width of $15/300^{th}$ of an inch and adjacent to the first Magenta colour strip, superposed on the second Cyan colour strip and overlapping by $1/300^{th}$ of an inch on the third Cyan colour strip.

e) a fourth line feed of $^{15}/_{300}{}^{th}$ of an inch is effected, and a fifth Cyan colour strip is printed, again having a width of $^{15}/_{300}{}^{th}$ of an inch, adjacent to the fourth Cyan colour strip, by means of a ninth and tenth pass separated by a line feed of $^{1}/_{300}{}^{th}$ of an inch and simultaneously, as well as a third Magenta colour strip, again with a width of $^{15}/_{300}{}^{th}$ of an inch adjacent to the second Magenta colour strip, superposed on the third Cyan colour strip and overlapping by $^{1}/_{300}{}^{th}$ of an inch on the fourth Cyan colour strip, a first Yellow colour strip, indicated by horizontal rows of dots in FIG.4*e*, is also printed using the 18 nozzles 122 of the group G', with a width of $^{17}/_{300}{}^{th}$ of an inch, superposed on the first Magenta colour strip and overlapping by $^{2}/_{300}{}^{th}$ of an inch on the second Magenta colour strip.

Figure 4F:
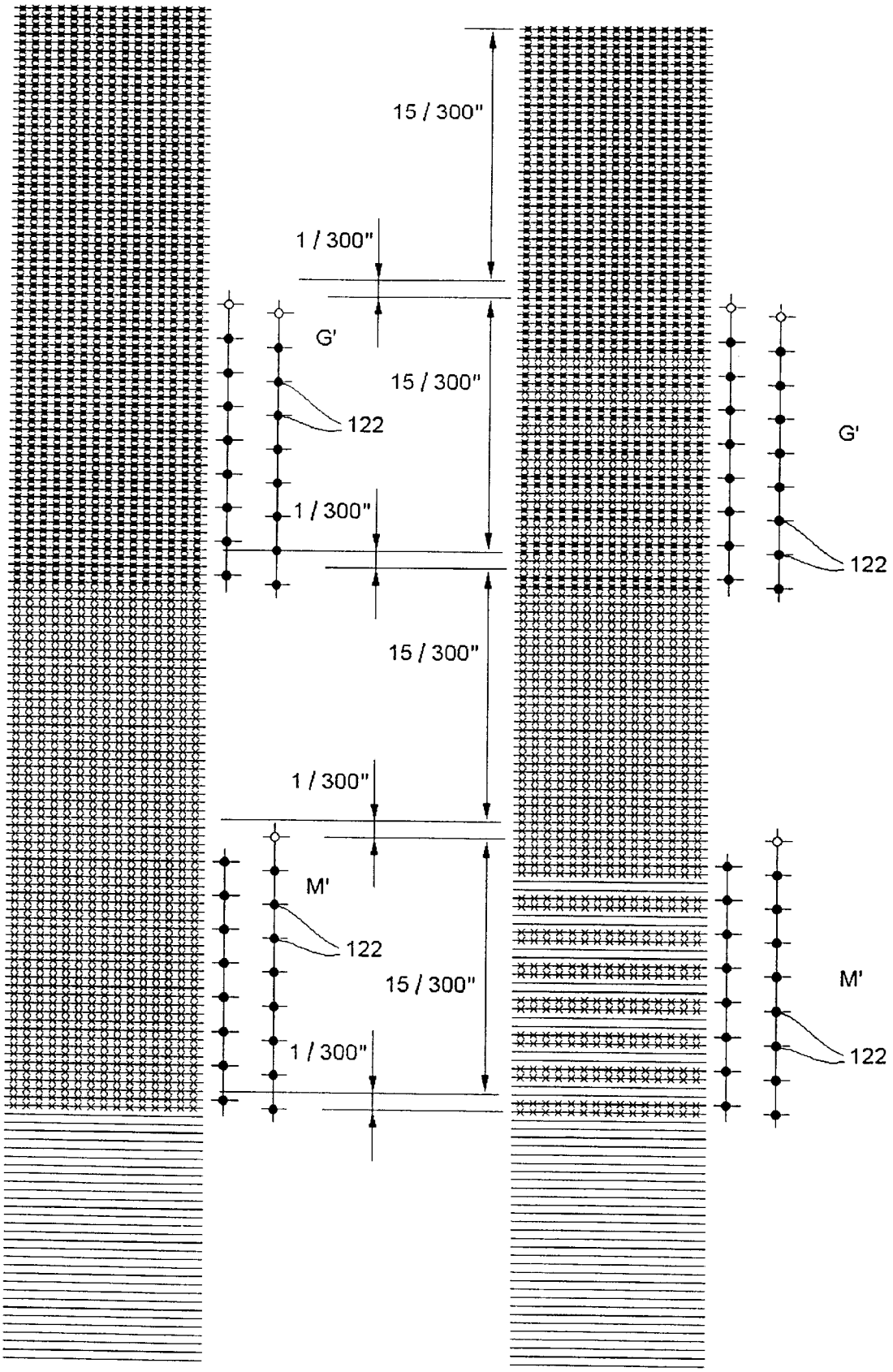

After the last-described step, in correspondence with the first Cyan colour strip deposited on the medium, the colour printing process is terminated, having obtained therein the superposition of the three fundamental colours, Cyan, Magenta and Yellow.

f) a fifth line feed of $^{15}/_{300}{}^{th}$ of an inch is then effected, and a sixth Cyan colour strip is printed, again having a width of *b* $^{15}/_{300}{}^{th}$ of an inch, adjacent to the fifth Cyan colour strip, by means of an eleventh and twelfth pass separated by a line feed of $^{1}/_{300}{}^{th}$ of an inch (FIG. 4*f*, where the Cyan nozzles C' and the sixth Cyan colour strip are omitted, as being identical in the previous figures) and simultaneously, as well as a fourth Magenta colour strip, again with a width of $^{15}/_{300}{}^{th}$ of an inch adjacent to the third Magenta colour strip, superposed on the fourth Cyan colour strip and overlapping by $^{1}/_{300}{}^{th}$ of an inch on the fifth Cyan colour strip, a second Yellow colour strip is also printed, using 16 nozzles 122 of the group G' (not using the first two nozzles, that are therefore represented by two empty circles), this time with a width of $^{15}/_{300}{}^{th}$ of an inch, superposed on the second Magenta colour strip and overlapping by $^{2}/_{300}{}^{th}$ of an inch on the third Magenta colour strip.

Or there may be more than three groups of nozzles. For example, a fourth group containing a "graphic" type black ink (that is to say, compatible with the three coloured inks, and therefore suitable for overlaying or shadowing coloured graphic areas) could be added to the three groups for the three inks coloured Cyan, Magenta and Yellow, or even a fifth group for a "traditional" black ink (that is to say, non compatible with the three coloured inks and therefore suitable for the printing of text characters and the like in non coloured areas only), both well-known to those acquainted with the sector art. A further possible variant of this solution consists in having the fifth group contain a "graphic" type black ink, though with a lower optical density than that of the "graphic" black ink of the fourth group.

Those with knowledge of the sector art will readily understand how the above-related process is repeated identically from this latter step onwards until colour printing of the entire medium is attained by the superposition of the three fundamental colours.

Naturally changes may be made to the invention described in the foregoing, without departing from the scope of the invention.

For example, the same inventive concept as expounded above may be applied to the case of a printer capable of effecting a minimum line feed of $^{1}/_{600}{}^{th}$ of an inch and the printhead, similar to the one denoted with the numeral 20 in FIG. 1, has three groups of nozzles wherein the constant pitch in the vertical direction is $^{1}/_{600}{}^{th}$ of an inch: by replacing this head with one similar to that denoted with the numeral 100 in FIG. 2, but in which the distance between corresponding couples of nozzles belonging to the two columns is reduced to $^{1}/_{1200}{}^{th}$ of an inch, and using the same double pass printing process with a line feed of $^{1}/_{600}{}^{th}$ of an inch between passes, prints are obtained with a definition of 1200×1200 dots/inch.

Further the groups of nozzles could be reduced to just one, in the event of monochrome heads, and more generally, the number of nozzles in each group could range from just a few to several hundred.

Finally the head according to the invention could be of the "monobloc" type, namely of the type wherein the ink well and the printhead true and proper form a single body; or it could be "refillable", wherein the ink well is interchangeable and can be replaced whenever empty.

In short, while adhering to the principle of this invention, details of the design and the forms of embodiment described and illustrated in the foregoing may be amply modified, without exiting from the scope of the invention.

What is claimed is:

1. An ink jet printhead, interchangeably fitted on a dot matrix printer for recording a high definition image on a medium, provided with respect to said medium with a scanning motion according to a first direction, and with a line feed motion according to a second direction perpendicular to said first direction, said line feed motion occurring in discrete pitches of a determined minimum value, said head also being provided with nozzles for the emission of droplets of an ink said nozzles being arranged at a constant pitch of value twice said minimum value in a first column parallel to said second direction and in a second column parallel to said first column, wherein the improvement comprises a first of said nozzles of said first column is separated according to said second direction from a first of said nozzles of said second column by a determined distance half the value of said minimum value.

2. An ink jet printhead according to the claim 1, wherein said nozzles are divided into a first group, into a second group and into a third group, and wherein said first group is separated according to said second direction from said second group by a first intergroup distance and said second group is separated according to said second direction from said third group by a second intergroup distance, wherein said first intergroup distance is different from said second intergroup distance.

3. An ink jet printhead according to the claim 2, wherein said first group comprises a first number of nozzles, said second group comprises a second number of nozzles different from said first number, and said third group comprises a third number of nozzles different from said first number and from said second number.

4. An ink jet printhead according to the claim 3, wherein said first group comprises 18 nozzles, said second group comprises 17 nozzles and said third group comprises 16 nozzles, and that said first intergroup distance is equal to $^{15}/_{300}{}^{th}$ of an inch and said second intergroup distance is equal to $^{16}/_{300}{}^{th}$ of an inch.

5. An ink jet printhead according to the claim 4, wherein said first group of nozzles emits droplets of yellow ink, said second group of nozzles emits droplets of magenta ink and said third group of nozzles emits droplets of cyan ink.

6. An ink jet printhead according to the claim 1, wherein said minimum value is equal to $^{1}/_{300}{}^{th}$ of an inch.

7. An ink jet printhead according to the claim 1, wherein said ink comprises a black ink and three coloured inks.

8. An ink jet printhead according to the claim 1, wherein said black ink comprises a "graphic" black ink and a "traditional" black ink.

9. An ink jet printhead according to the claim 1, wherein said black ink comprises a first "graphic" black ink having a first optical density, and a second "graphic" black ink having a second optical density lower than said first optical density.

10. An inkjet printing method for printing high definition images on a medium by means of a succession of printing passes separated by line feed movements, wherein it comprises the following steps:

providing a printhead according to the claim 1, performing a first printing pass selectively emitting droplets of said ink on said medium by means of said printhead, performing a line feed movement of value equal to said minimum value, performing a second printing pass selectively emitting droplets of said ink on said medium by means of said printhead.

11. An ink jet printing method according to the claim 10, wherein said ink comprises an ink selected from a group consisting of a cyan ink, a yellow ink, a magenta ink, a "graphic" black ink and a "traditional" black ink.

12. An ink jet printhead, interchangeably fitted on a dot matrix printer for recording a high definition image on a medium, provided with respect to said medium with a scanning motion according to a first direction, and with a line feed motion according to a second direction perpendicular to said first direction, said line feed motion occurring in discrete pitches of a determined minimum value, said head also being provided with nozzles for the emission of droplets of an ink arranged at a constant pitch in a first column parallel to said second direction and in a second column parallel to said first column, said constant pitch being twice the size of said minimum value, wherein the improvement consists in that said nozzles of said first column are staggered according to said second direction with respect to said nozzles of said second column by a determined distance half the size of said minimum value.

* * * * *